United States Patent [19]

Charters, Jr.

[11] Patent Number: 4,972,598

[45] Date of Patent: Nov. 27, 1990

[54] SIGN-MAKERS TEMPLATE

[76] Inventor: Robert C. Charters, Jr., 131 N. Crescent Dr., Rome, N.Y. 13440

[21] Appl. No.: 500,547

[22] Filed: Mar. 28, 1990

[51] Int. Cl.[5] ..... B43L 13/20

[52] U.S. Cl. ..... 33/564

[58] Field of Search ..... 33/562, 564, 565, 566; 101/127.1, 128, 128.1

[56] References Cited

U.S. PATENT DOCUMENTS

| | | | |
|---|---|---|---|
| 87,727 | 3/1869 | Tarbox | 101/128 |
| 1,821,369 | 9/1931 | Wetterstrand | 33/564 |
| 4,274,459 | 6/1981 | Galajda | 33/564 X |

*Primary Examiner*—Harry N. Haroian
*Attorney, Agent, or Firm*—Leon Gilden

[57] ABSTRACT

An apparatus including a series of rectangular frames of various sizes to accommodate each of the letters of the alphabet. The framework includes three horizontal centering lines dividing the rectangular framework, with the centering lines equally spaced adjacent a rectangular center space defined by the framework. A single vertical line bisects the rectangular space and is directed through each upper and lower side of the rectangular framework. The apparatus further includes magnetic strips mounted adjacent each corner of the framework upon a bottom surface thereof to receive a stencil adherably thereon to align the stencil in use, and wherein each framework further includes hook and loop fastener members to secure adjacent frameworks in a side-by-side relationship. Fiber optic transmission lines are directed through the framework in a modification thereof in lieu of the centering lines to illuminate the centering lines and appropriately divide the center space during light conditions for use by individuals.

4 Claims, 4 Drawing Sheets

PRIOR ART

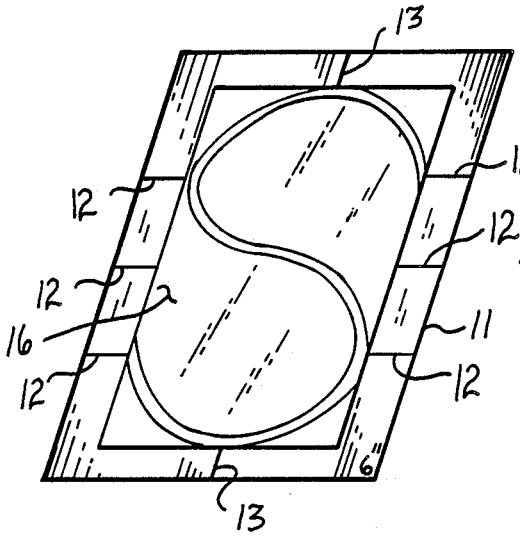
FIG 3
FIG 4
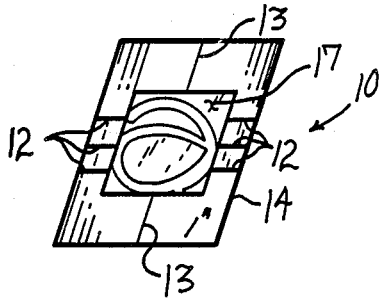
FIG 5
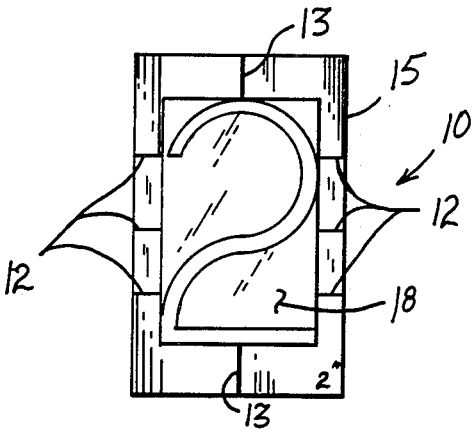

SIGN-MAKERS TEMPLATE

BACKGROUND OF THE INVENTION

1. Field of the Invention

The field of invention relates to template apparatus, and more particularly pertains to a new and improved lettering template apparatus wherein the same is provided in a series of various sizes to accommodate various sign making conditions, and to further provide for convenient securement and positioning of adjacent frameworks together.

2. Description of the Prior Art

Templates of various configurations have been set forth in the prior art to permit lettering to be carefully directed upon various surfaces, such as sign boards and the like.

Examples of the prior art include U.S. Pat. 4,470,197 to Pagalies wherein a lettering guide utilizes upper and lower case letters directed through the guide, as well as numerical symbols and the like, with the guide mounted slidingly within a framework to permit lettering of a surface underlying the guide.

U.S. Pat. 1,369,470 to Rian sets forth a template sheet wherein various openings and arcuate, as well as linear lines, are directed through the sheet to accommodate the alphabet and the like to permit the stenciling of such characters on an underlying sheet.

U.S. Pat. 217,736 to Kibbe sets forth a lettering guide provided with various arcs to accommodate positioning and lettering of letters and the like to a surface underlying the guide.

U.S. Design Pat. 253,462 to Packard and 41,933 to Gosnell are illustrative of various pre-inscribed guides for use as templates in a stenciling procedure.

As such, it may be appreciated that there continues to be a need for a new and improved lettering template apparatus wherein the same addresses both the problems of ease of use, as well as effectiveness in construction in directing lettering onto a surface and in this respect, the present invention substantially fulfills this need.

SUMMARY OF THE INVENTION

In view of the foregoing disadvantages inherent in the known types of lettering template apparatus now present in the prior art, the present invention provides a lettering template apparatus wherein the same permits the use of variously sized letters utilizing frameworks easily assembled and secured together relative to one another to effect lettering of a surface underlying the frameworks. As such, the general purpose of the present invention, which will be described subsequently in greater detail, is to provide a new and improved lettering template apparatus which has all the advantages of the prior art lettering template apparatus and none of the disadvantages.

To attain this, the present invention provides an apparatus including a series of rectangular frames of various sizes to accommodate each of the letters of the alphabet. The framework includes three horizontal centering lines dividing the rectangular framework, with the centering lines equally spaced adjacent a rectangular center space defined by the framework. A single vertical line bisects the rectangular space and is directed through each upper and lower side of the rectangular framework. The apparatus further includes magnetic strips mounted adjacent each corner of the framework upon a bottom surface thereof to receive a stencil adherably thereon to align the stencil in use, and wherein each framework further includes hook and loop fastener members to secure adjacent frameworks in a side-by-side relationship. Fiber optic transmission lines are directed through the framework in a modification thereof in lieu of the centering lines to illuminate the centering lines and appropriately divide the center space during light conditions for use by individuals.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lettering template apparatus which has all the advantages of the prior art lettering template apparatus and none of the disadvantages.

It is another object of the present invention to provide a new and improved lettering template apparatus which may be easily and efficiently manufactured and marketed.

It is a further object of the present invention to provide a new and improved lettering template apparatus which is of a durable and reliable construction.

An even further object of the present invention is to provide a new and improved lettering template apparatus which is susceptible of a low cost of manufacture with regard to both materials and labor, and which accordingly is then susceptible of low prices of sale to the consuming public, thereby making such lettering template apparatus economically available to the buying public.

Still yet another object of the present invention is to provide a new and improved lettering template apparatus which provides in the apparatuses and methods of the prior art some of the advantages thereof, while simultaneously overcoming some of the disadvantages normally associated therewith.

Still another object of the present invention is to provide a new and improved lettering template apparatus wherein the same permits the convenient securement and positioning of templates together in a predetermined relationship to permit directing of letters onto an underlying surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 3, 4, and 5 are top orthographic illustrations of templates utilized by the instant invention.

DESCRIPTION OF THE PREFERRED EMBODIMENT

Figure 1:
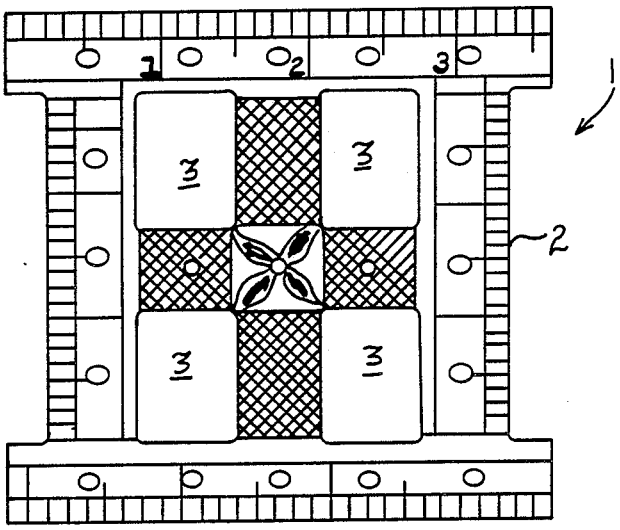
FIG. 1 is a top orthographic view of a prior art template.

With reference now to the drawings, and in particular to FIGS. 1 to 9 thereof, a new and improved lettering template apparatus embodying the principles and concepts of the present invention and generally designated by the reference numerals 10, **10*a*, and 10*b*** will be described.

Figure 2:
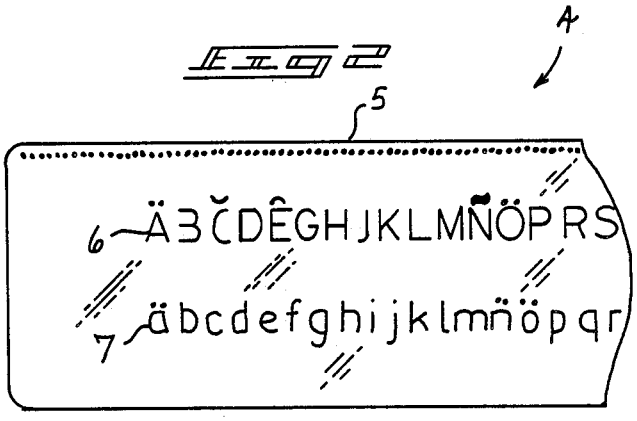
PRIOR ART FIG 2
FIG. 2 is a top orthographic view of an example of a further prior art template.

FIG. 1 is illustrative of a typical prior art template 1 defined by a framework 2 provided with a plurality of rectangular faces 3 therewithin. FIG. 2 illustrates a prior art template 4 defined as a plate 5 utilizing spaces for upper case letters 6 and lower case letters 7 to be directed onto an underlying surface. The template 5 is arranged for use in a sliding relationship relative to a support framework to enable guiding of the template overlying an underlying surface.

FIGS. 3, 4, and 5 illustrate the respective use of a first rectangular framework 11, a second rectangular framework 14, and third rectangular framework 15 of varying sizes to indicate that the templates are contemplated for use of variously sized letters mounted within a rectangular central space 16. The frameworks clearly are formed to accommodate the twenty-six letters of the alphabet in both upper and lower case designations, as well as numerical and symbolic designations. The framework includes a series of three spaced horizontal centering lines 12 for alignment and positioning of letters within the central opening 16, as well as a single vertical centering line 13 directed through each upper and lower horizontal side of the framework to bisect the upper and lower horizontal sides and the associated rectangular central spaces 16, 17, and 18 of the respective first, second, and third rectangular frameworks.

Figure 6:
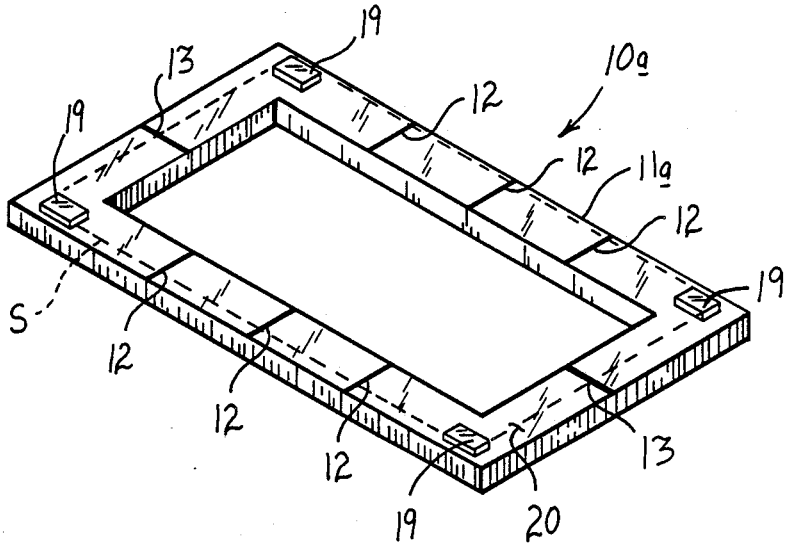
FIG. 6 is a bottom isometric illustration of a template framework utilized by the instant invention.

FIG. 6 illustrates the lettering template apparatus **10*a* utilizing a modified framework 11*a* formed of a transparent polymeric material. The framework includes the aforenoted three horizontal center lines 13 directed through each side of the framework equally dividing the central space opening defined by the framework, and the single vertical centering line 13 directed and bisecting the central space dividing the upper and lower sides of the framework. Ferromagnetic strips 19 are mounted adjacent each corner of the rectangular framework 11*a* to permit attachment of a stencil "S" to the ferromagnetic strips 19 to permit utilization of various stencils with the single framework, wherein the transparent construction of the framework permits visual alignment of each of the stencils when the frameworks are positioned in a side-by-side relationship. The ferromagnetic strips 19 are understandably attached integrally to the bottom surface 20 of the framework 11*a***.

Figure 7:
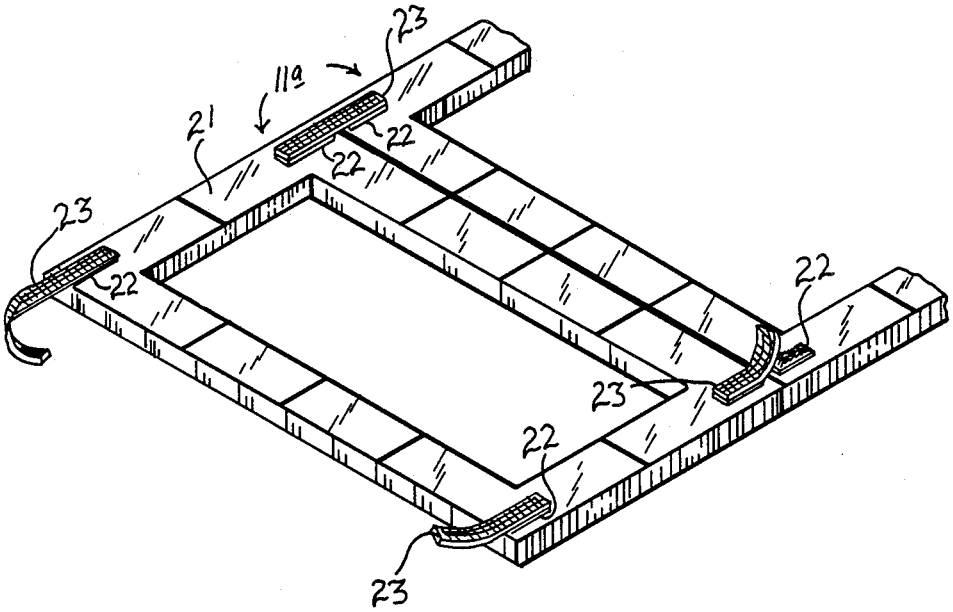
FIG. 7 is a top isometric illustration of a plurality of frameworks utilized by the instant invention.

FIG. 7 illustrates the securement of adjacent frameworks **11*a* together, wherein first hook and loop fastener patches are mounted adjacent each corner of each framework 11*a*, with a second hook and loop flexible band 23 spanning each framework to secure adjacent hook and loop fastener patches together to securably mount the frameworks in a side-by-side relationship mounting the stencils underlying the framework as attached to the magnets 19, per the illustration of FIG. 6. The hook and loop fastener patches 22 are mounted to the top surface 21** to each of the frameworks, as illustrated.

Figures 8, 9:
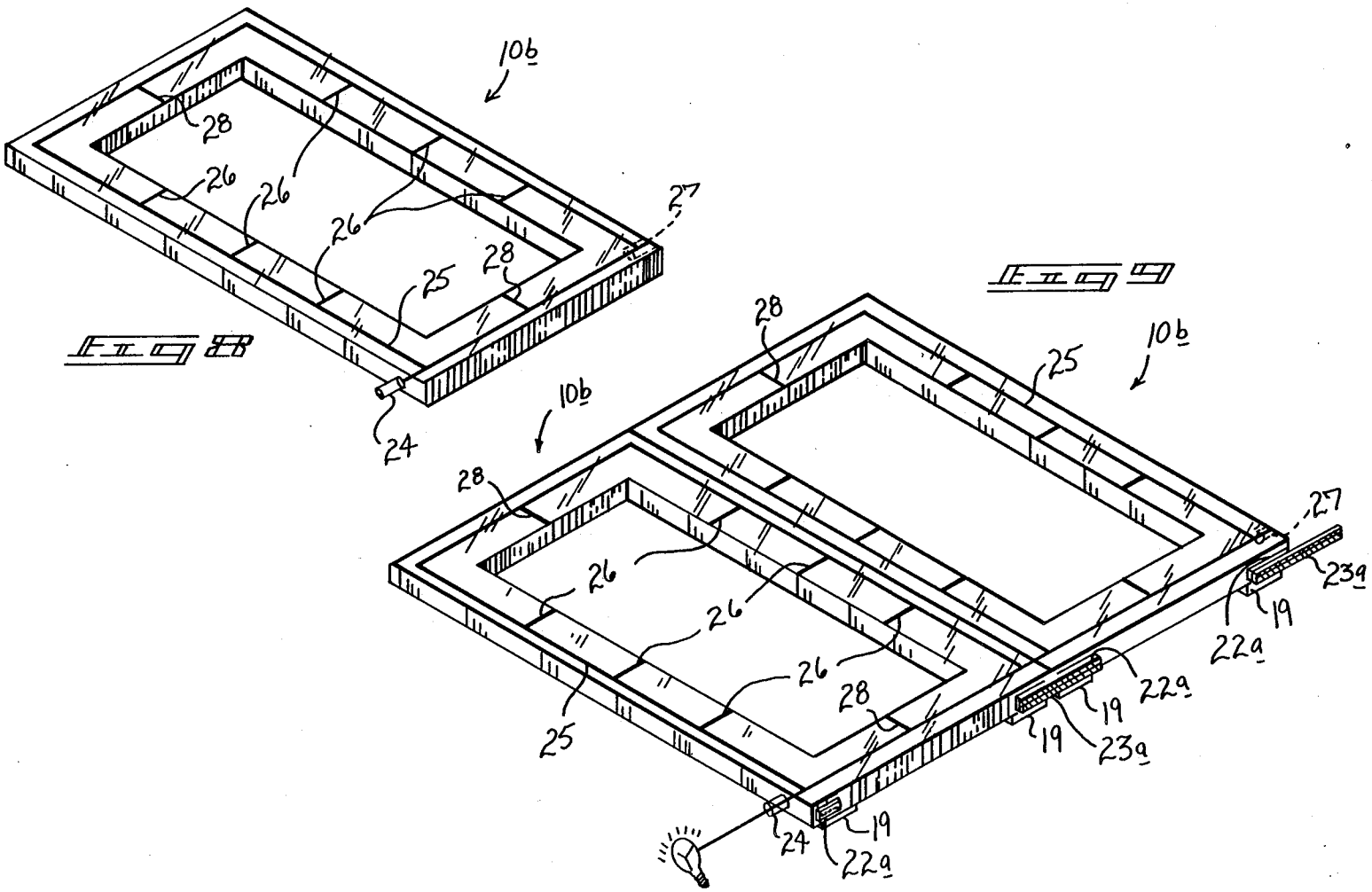
FIG. 8 is an isometric illustration of a modification of the instant invention.
FIG. 9 is an isometric illustration of a plurality of frameworks secured together.

FIG. 8 illustrates a further modified apparatus **10*b*, wherein the framework further includes a tubular light transmission cylinder 24 receivable within a tubular light transmission socket 27 mounted within an adjacent framework. The cylinders 24 and the sockets 27 direct light therethrough to direct light from a light source through the fiber optic transmission lines 25 formed within the framework. The fiber optic transmission lines are defined by a rectangular fiber optic line mounted within the transparent framework, with spaced horizontal centering lines 26 mounted orthogonally equally dividing the central space defined by the framework, with a single vertical fiber optic line 28 bisecting the upper and lower sides of the framework for enhanced positioning of stencils mounted to the magnets 19 underlying each of the frameworks. As illustrated in FIG. 9, the magnets 19 are positioned adjacent each corner of the bottom surface of each framework, and are positioned in a reversed polarity relative to one another relative to respective frameworks, wherein a north pole of a first framework is positioned adjacent a south pole of a further adjacent framework to effect the traction between the adjacent frameworks, as illustrated in FIG. 9. This alignment of reversed polarity orientation of the ferromagnetic strips 19 enhances securement and initial positioning of the frameworks together. The further hook and loop fastener patches 22*a* are mounted on the side surfaces of upper and lower ends of the respective frameworks for receiving the hook and loop flexible fastener strip 23*a*** to secure the adjacent frameworks together.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lettering template apparatus including a rectangular framework defined by spaced left and right side walls orthogonally arranged relative to top and bottom side walls, and the rectangular framework defining a rectangular opening in a surrounding relationship thereto, and a stencil member mounted underlying the rectangular opening, and equally spaced first indicia orthogonally directed across each of the left and right side walls equally spaced relative to one another relative to the rectangular opening, and a single second indicia directed orthogonally across the top and bottom side walls bisecting the top and bottom side walls, and wherein the rectangular framework is formed of a transparent polymeric material, and including a magnetic strip mounted to a bottom surface of the rectangular framework adjacent each corner of the rectangular framework, each magnetic strip arranged to magnetically secure the stencil member thereto.

2. An apparatus as set forth in claim 1 including a hook and loop fastener patch mounted on the rectangular framework adjacent each corner of the framework, and a flexible hook and loop fastener strip securable to each hook and loop fastener patch to secure adjacent rectangular frameworks together.

3. An apparatus as set forth in claim 2 wherein the rectangular framework defines a top surface, and each hook and loop fastener patch is mounted on each edge surface between the top surface and the bottom surface of each rectangular framework.

4. An apparatus as set forth in claim 3 wherein each rectangular framework includes a tubular light transmission cylinder directed orthogonally and outwardly relative to a left side edge surface between the top surface and bottom surface of the rectangular framework, and each transmission cylinder receivable within a light transmission socket formed within each right side edge surface between the top surface and bottom surface of each framework, and a fiber optic transmission line formed in surrounding relationship through the rectangular framework in light communication with each light transmission cylinder and each light transmission socket, and the first and second indicia are defined by a fiber optic filament directed through the transparent framework.

* * * * *